US011349205B2

(12) United States Patent
Kim et al.

(10) Patent No.: US 11,349,205 B2
(45) Date of Patent: May 31, 2022

(54) BEAMFORMING ANTENNA ASSEMBLY INCLUDING METAL STRUCTURE

(71) Applicant: Samsung Electronics Co., Ltd., Suwon-si (KR)

(72) Inventors: Yoongeon Kim, Suwon-si (KR); Seungtae Ko, Suwon-si (KR); Taesik Yang, Suwon-si (KR); Juneyong Young, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 160 days.

(21) Appl. No.: 15/796,297

(22) Filed: Oct. 27, 2017

(65) Prior Publication Data

US 2018/0138591 A1 May 17, 2018

Related U.S. Application Data

(60) Provisional application No. 62/420,688, filed on Nov. 11, 2016.

(30) Foreign Application Priority Data

Dec. 28, 2016 (KR) ..... 10-2016-0181476

(51) Int. Cl.
*H01Q 1/42* (2006.01)
*H01Q 3/12* (2006.01)
(Continued)

(52) U.S. Cl.
CPC ..... *H01Q 3/12* (2013.01); *H01Q 1/325* (2013.01); *H01Q 1/528* (2013.01); *H01Q 3/26* (2013.01);
(Continued)

(58) Field of Classification Search
None
See application file for complete search history.

(56) References Cited

U.S. PATENT DOCUMENTS 6,031,500 A 2/2000 Nagy et al.
7,181,160 B2 2/2007 Barrett
(Continued)

FOREIGN PATENT DOCUMENTS

CN 1545727 A 11/2004
CN 101420067 A 4/2009
(Continued)

OTHER PUBLICATIONS

European Search Report dated Aug. 1, 2019, issued in the European Application No. 17869209.1.
(Continued)

*Primary Examiner* — Trinh V Dinh
(74) *Attorney, Agent, or Firm* — Jefferson IP Law, LLP

(57) ABSTRACT

A communication technique and a system thereof that fuse a $5^{th}$ generation (5G) communication system for supporting a higher data transmission rate in a beyond $4^{th}$ generation (4G) system to internet of things (IoT) technology are provided. The communication technique and a system thereof may be applied to an intelligent service (e.g., smart home, smart building, smart city, smart car or connected car, health care, digital education, retail business, security and safety related service) based on 5G communication technology and IoT related technology. Further, a beamforming antenna assembly including a metal structure and particularly, a beamforming antenna assembly that can minimize a communication distortion of a beamforming antenna due to an influence of a metal is provided.

20 Claims, 15 Drawing Sheets

(51) Int. Cl.

| | |
|---|---|
| ***H01Q 1/32*** | (2006.01) |
| ***H01Q 3/26*** | (2006.01) |
| ***H01Q 1/52*** | (2006.01) |
| *H01Q 15/00* | (2006.01) |

(52) U.S. Cl.
CPC ..... *H01Q 1/32* (2013.01); *H01Q 1/42* (2013.01); *H01Q 15/0013* (2013.01)

(56) References Cited

U.S. PATENT DOCUMENTS

| | | | | |
|---|---|---|---|---|
| 7,297,902 | B2 | 11/2007 | Weiss | |
| 7,453,147 | B2 | 11/2008 | Ida et al. | |
| 9,368,859 | B2 * | 6/2016 | Forslund | H01Q 1/3291 |
| 9,559,426 | B1 * | 1/2017 | Cross | H01Q 15/0013 |
| 2005/0057904 | A1 | 3/2005 | Nakabuchi | |
| 2006/0092086 | A1 | 5/2006 | Franson et al. | |
| 2009/0064741 | A1 | 3/2009 | Katagiri | |
| 2010/0053004 | A1 | 3/2010 | Schillmeier et al. | |
| 2014/0035783 | A1 | 2/2014 | Contarino et al. | |
| 2014/0145887 | A1 | 5/2014 | Irvine | |
| 2015/0123865 | A1 | 5/2015 | Dobric | |
| 2015/0207213 | A1 * | 7/2015 | Forslund | H01Q 1/3291 343/713 |
| 2016/0025788 | A1 * | 1/2016 | Fujita | G01R 31/2822 343/703 |
| 2016/0315378 | A1 | 10/2016 | Kiriyama et al. | |
| 2016/0351996 | A1 * | 12/2016 | Ou | H01Q 21/065 |

FOREIGN PATENT DOCUMENTS

| | | | |
|---|---|---|---|
| CN | 102099959 | A | 6/2011 |
| CN | 102723541 | A | 10/2012 |
| CN | 105291974 | A | 2/2016 |
| EP | 2 850 693 | B1 | 7/2016 |
| JP | 2003-309410 | A | 10/2003 |
| JP | 2007/295505 | A | 11/2007 |
| JP | 2009-272974 | A | 11/2009 |
| JP | 5095490 | B2 | 12/2012 |
| KR | 10-0641835 | B1 | 11/2006 |
| KR | 10-2015-0051975 | A | 5/2015 |
| KR | 10-2016-0012746 | A | 2/2016 |
| KR | 10-1600266 | B1 | 3/2016 |
| WO | 01/15275 | A1 | 3/2001 |
| WO | 2012/106021 | A1 | 8/2012 |
| WO | 2014/058360 | A1 | 4/2014 |

OTHER PUBLICATIONS

Chinese Office Action dated Aug. 5, 2020, issued in Chinese application No. 201780066811.3.
European Office Action dated Jun. 9, 2021, issued in European Application No. 17869209.1.
Chinese Office Action / Notice of Allowance / dated Dec. 22, 2021, issued in Chinese Application No. 201780066811.3.

* cited by examiner

BEAMFORMING ANTENNA ASSEMBLY INCLUDING METAL STRUCTURE

CROSS-REFERENCE TO RELATED APPLICATION(S)

This application claims the benefit under 35 U.S.C. § 119(e) of a U.S. provisional application filed on Nov. 11, 2016 in the U.S. Patent and Trademark Office and assigned Ser. No. 62/420,688, and under 35 U.S.C. § 119(a) of a Korean patent application filed on Dec. 28, 2016 in the Korean Intellectual Property Office and assigned Serial number 10-2016-0181476, the entire disclosure of each of which is hereby incorporated by reference.

TECHNICAL FIELD

The present disclosure relates to a beamforming antenna assembly including a metal structure. More particularly, the present disclosure relates to a beamforming antenna assembly that can minimize a communication distortion of a beamforming antenna due to an influence of a metal.

BACKGROUND

Efforts are being made to develop an enhanced $5^{th}$ generation (5G) communication system or a pre-5G communication system in order to satisfy increase in demand for wireless data traffic as a $4^{th}$ generation (4G) communication system is now commercially available. Therefore, a 5G communication system or a pre-5G communication system is referred to as a beyond 4G network communication system or a post long-term evolution (LTE) system. In order to achieve a high data transmission rate, consideration is being given to implementing the 5G communication system in a mmWave band (e.g., 60 GHz band). In order to mitigate any route loss of electronic waves in a mmWave band and to increase transmission distances of electronic waves, the technologies of beamforming, massive multiple input and output (MIMO), full dimensional MIMO (FD-MIMO), array antenna, analog beamforming, and large scale antenna have been discussed for the 5G communication system. Further, in order to enhance networks in the 5G communication system, the technologies of an innovative small cell, advanced small cell, cloud radio access network (cloud RAN), ultra-dense network, device to device communication (D2D), wireless backhaul, moving network, cooperative communication, coordinated multi-points (CoMP), and interference cancellation have been developed. In addition, hybrid frequency-shift keying (FSK) and quadrature amplitude modulation (QAM) modulation (FQAM) and sliding window superposition coding (SWSC), which are advanced coding modulation (ACM) methods, and filter bank multi carrier (FBMC), non-orthogonal multiple access (NOMA), and sparse code multiple access (SCMA), which are advanced access technologies, have been developed for the 5G system.

Internet has been innovated from a human-based connection network in which a human generates and consumes information to an internet of things (IoT) network that gives and receives and processes information to and from distributed constituent elements, such as things. Internet of everything (IoE) technology in which big data processing technology through connection to a cloud server is combined with IoT technology has been appeared. In order to implement IoT, technology elements, such as sensing technology, wired and wireless communication and network infrastructure, service interface technology, and security technology are required, thus, nowadays, technology of a sensor network, machine to machine (M2M), and machine type communication (MTC) for connection between things has been researched. In an IoT environment, an intelligent internet technology (IT) service that collects and analyzes data generated in connected things to provide a new value to a human life may be provided. IoT may be applied to a field of a smart home, smart building, smart city, smart car or connected car, smart grid, health care, smart home appliances, and high-tech medical service through fusion and complex between existing information technology (IT) technology and various industries.

Accordingly, various attempts for applying a 5G communication system to an IoT network have been performed. For example, technologies, such as a sensor network, M2M, and MTC have been implemented by a technique of beamforming, MIMO, and array antenna, which are 5G communication technology. Application of a cloud RAN as the foregoing big data processing technology may be an example of fusion of 5G technology and IoT technology.

A largest characteristic of 5G communication technology is that an electric wave loss according to a distance increases larger in a high frequency band than in a low frequency band. However, because a wavelength is also shortened, by applying beamforming using a high gain analog directional antenna of a multiple antenna, an electric wave loss can be overcome. Therefore, a beamforming design using a multiple antenna is an important research direction in 5G communication.

More particularly, a metal exists at a periphery of an antenna using for beamforming, and when a beamforming antenna scans to search for beams appropriate to electric wave transmission, electric waves are blocked by the metal and a scan performance of the antenna may be thus deteriorated, thus, there is a problem that a 5G antenna and a metal cannot be together used without addressing such an issue.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problem and/or disadvantages and to provide at least the advantages described below. Accordingly, an aspect of the present disclosure is to provide a beamforming antenna assembly including a metal structure that can transmit beams emitted through a beamforming antenna to the outside without distortion and blocking by a metal.

In accordance with an aspect of the present disclosure, a beamforming antenna assembly is provided. The beamforming antenna assembly includes a metal structure having a groove, and a beamforming antenna disposed at the metal structure groove, wherein an outer edge of the metal structure groove is extended to an outer edge of the beamforming antenna to form a metal structure inclined surface.

In an implementation, beams emitted from the beamforming antenna are guided along the metal structure inclined surface.

In an implementation, an outermost area of the metal structure groove is larger than an area of the beamforming antenna.

In an implementation, when one side surface of beams emitted through the beamforming antenna contacts the metal structure inclined surface to satisfy a short boundary condition, the other side surface of the beam forms a tilt angle in order to satisfy an open boundary condition.

In an implementation, beams emitted in a predetermined emission angle from the beamforming antenna are guided along the metal structure inclined surface to be emitted while maintaining the emission angle to the outside of the metal structure.

In an implementation, a tilt angle of the metal structure inclined surface is determined based on a wavelength of the beamforming antenna.

In an implementation, the metal structure inclined surface includes a period structure pattern.

In an implementation, the beamforming antenna assembly further includes a radome configured to cover the metal structure groove, and the radome includes at least one of a frequency selective surface (FSS) or a phase converter.

In accordance with another aspect of the present disclosure, a beamforming antenna assembly is provided. The beamforming antenna assembly includes a metal structure having a groove, a beamforming antenna disposed at the metal structure groove, and a guide surface disposed between the beamforming antenna and the metal structure along an outer edge of the beamforming antenna and an outer edge of the metal structure groove to guide beams emitted from the beamforming antenna.

In an implementation, an outermost area of the metal structure groove is larger than an area of the beamforming antenna.

In an implementation, the guide surface is disposed to form a tilt angle by a predetermined angle along an outer edge of the beamforming antenna and an outer edge of the metal structure groove to enlarge an emission area of beams emitted through the beamforming antenna.

In an implementation, when one side surface of beams emitted through the beamforming antenna contacts the guide surface to satisfy a short boundary condition, the other side surface of the beam is formed to satisfy an open boundary condition.

In an implementation, the tilt angle of the guide surface is determined based on a wavelength of the beamforming antenna.

In an implementation, the guide surface includes a period structure pattern.

In an implementation, the beamforming antenna assembly further includes a radome configured to cover the groove, and the radome includes at least one of a FSS or a phase converter.

In accordance with another aspect of the present disclosure, a beamforming antenna assembly for a vehicle is provided. The beamforming antenna assembly includes a metal frame for a vehicle having a groove, and a beamforming antenna disposed at the metal frame groove, wherein an outer edge of the metal frame groove is extended to an outer edge of the beamforming antenna to form a metal frame inclined surface.

In an implementation, beams emitted from the beamforming antenna are guided along the metal frame inclined surface.

In an implementation, an outermost area of the metal frame groove is larger than an area of the beamforming antenna.

In an implementation, beams emitted in a predetermined emission angle from the beamforming antenna are guided along an inclined surface of the metal frame to be emitted while maintaining the emission angle to the outside of the metal frame.

In accordance with another aspect of the present disclosure, a beamforming antenna assembly for a vehicle is provided. The beamforming antenna assembly includes a metal panel for a vehicle having a groove, and a beamforming antenna disposed at the metal panel groove, wherein an outer edge of the metal panel groove is extended to an outer edge of the beamforming antenna to form an inclined surface.

In an implementation, the beamforming antenna assembly further includes a radome configured to cover the groove.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
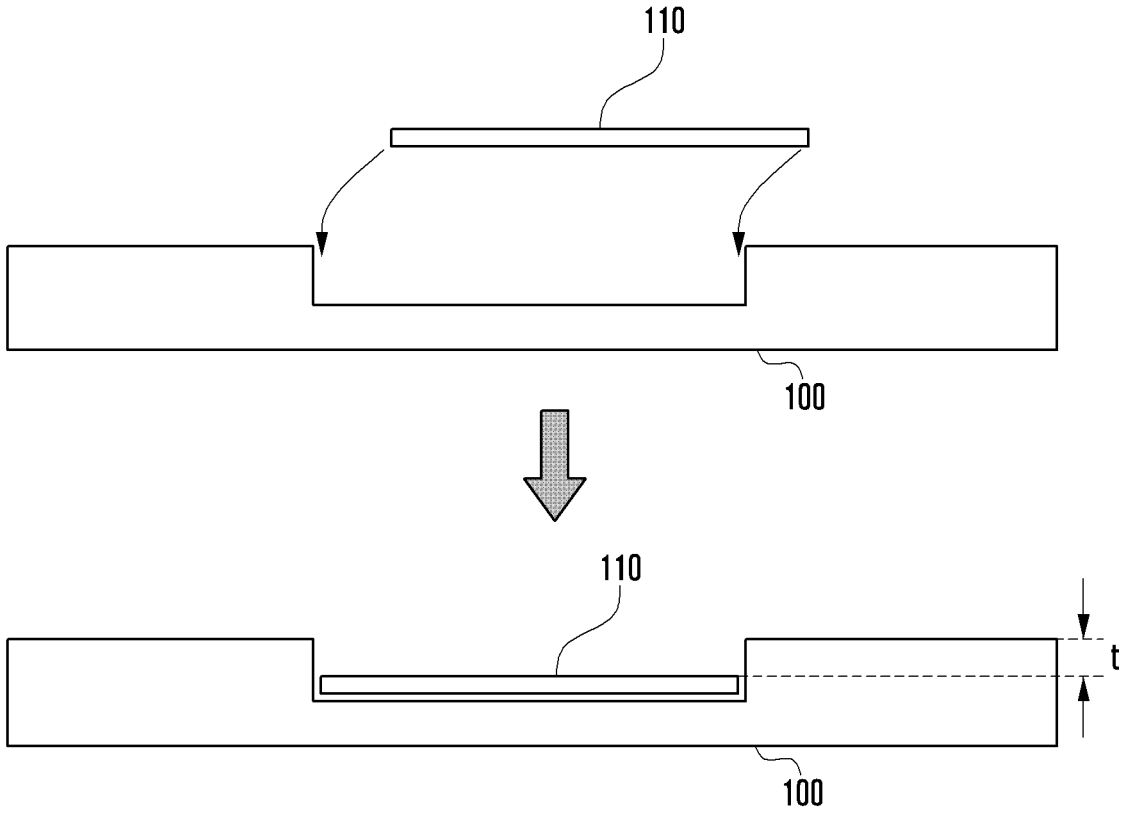
FIG. 1 is a diagram illustrating a structure in which a beamforming antenna is disposed at a groove of a metal structure according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Similarly, in the attached drawings, some constituent elements are shown in an exaggerated or schematic form or are omitted. Further, a size of each constituent element does not entirely reflect an actual size. Like reference numerals designate like elements in the drawings.

These advantages and features of the present disclosure and a method of accomplishing them will become more readily apparent from the detailed description given hereinafter together with the accompanying drawings. However, the present disclosure is not limited to the following various embodiments of the present disclosure, and it may be implemented in different forms. The present various embodiments enable the complete disclosure of the present disclosure and are provided to enable complete knowledge of the scope of the disclosure to those skilled in the art, and the present disclosure is defined by the scope of the claims. Like reference numerals designate like elements throughout the specification.

Herein, it may be understood that each block of a flowchart and combinations of the flowchart may be performed by computer program instructions. Because these computer program instructions may be mounted in a processor of a universal computer, a special computer, or other programmable data processing equipment, the instructions performed through a processor of a computer or other programmable data processing equipment generate a means that performs functions described in a block(s) of the flowchart. In order to implement a function with a specific method, because these computer program instructions may be stored at a computer available or computer readable memory that can direct a computer or other programmable data processing equipment, instructions stored at the computer available or computer readable memory may produce a production item including an instruction means that performs a function described in block(s) of the flowchart. Because computer program instructions may be mounted on a computer or other programmable data processing equipment, a series of operation are performed on the computer or other programmable data processing equipment and generate a process executed with the computer, and instructions that direct the computer or other programmable data processing equipment may provide operations for executing functions described in block(s) of the flowchart.

Further, each block may represent a portion of a module, segment, or code including at least one executable instruction for executing a specific logical function(s). Further, in several replaceable execution examples, it should be noted that functions described in blocks may be performed regardless of order. For example, two consecutively shown blocks may be substantially simultaneously performed or may be sometimes performed in reverse order according to a corresponding function.

In this case, a term '-unit' used in the present an embodiment means a software or hardware component, such as a field programmable gate array (FPGA) or an application specific integrated circuit (ASIC) and performs any function. However, "-unit" is not limited to software or hardware. A "-unit" may be configured to store at a storage medium that can address and may be configured to reproduce at least one processor. Therefore, "-unit" includes, for example, components, such as software components, object-oriented software components, class components, and task components, processes, functions, attributes, procedures, subroutines, segments of a program code, drivers, firmware, microcode, circuit, data, database, data structures, tables, arrays, and variables. A function provided within constituent elements and "-units" may be performed by coupling the smaller number of constituent elements and "-units" or by subdividing the constituent elements and "-units" into additional constituent elements and "-units". Further, constituent elements and "-units" may be implemented in a manner to reproduce at least one central processing unit (CPU) within a device or a security multimedia card. Further, in an embodiment of the present disclosure, '-unit' may include at least one processor.

A frequency domain applied to a 5th generation (5G) communication system according to an embodiment of the present disclosure is not limited to a specific frequency domain. In a frequency domain of 30 GHz or 60 GHz or more, a 5G communication system may be applied, but this is an embodiment and a frequency domain that may be applied to the 5G communication system may be changed, as needed. For example, when an antenna assembly according to an embodiment of the present disclosure includes an antenna that performs a beamforming operation, the antenna assembly may be applied regardless of an operation frequency domain.

FIG. 1 is a diagram illustrating a structure in which a beamforming antenna is disposed at a groove of a metal structure according to an embodiment of the present disclosure.

Referring to FIG. 1, a metal blocks beams emitted through a beamforming antenna. Therefore, a best method of disposing an antenna at a metal is a method of disposing a beamforming antenna at the outside of a metal.

However, when disposing a beamforming antenna at the outside of a metal, the beamforming antenna may be broken by an external impact. Further, in this case, because only the beamforming antenna may be protruded to the outside of a metal surface, it is unpreferable from an aesthetic viewpoint.

Therefore, in order to address the issue, as shown in FIG. 1, a structure should be used that forms a groove at a metal structure 100 to dispose a beamforming antenna 110 at the groove.

In a structure of FIG. 1, a most ideal disposition of the metal structure 100 and the beamforming antenna 110 is a case in which a separation distance t between a surface of the metal structure 100 and the beamforming antenna 110 becomes 0.

However, due to a tolerance occurring in a production process of the metal structure and the beamforming antenna, it is impossible to accurately adjust the t to 0. Therefore, due to difficulty in such a production process, a separation distance t may occur between the metal structure 100 and the beamforming antenna 110, thus, beams emitted through the beamforming antenna 110 may be distorted. The reason why a distortion of beams occurs will be described later.

Figure 2:
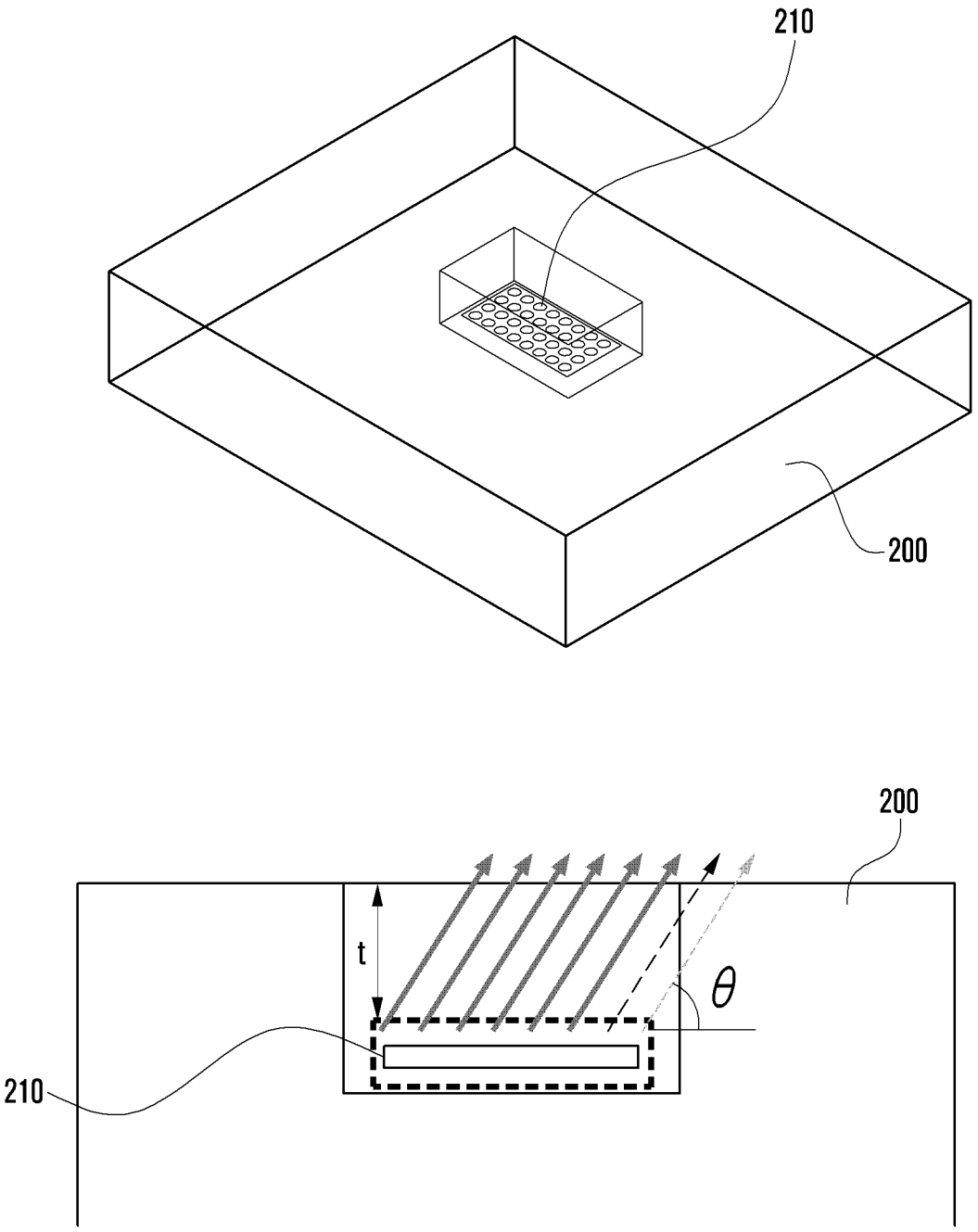
FIG. 2 is a diagram illustrating a case of emitting beams in a state in which a beamforming antenna is disposed at a groove of a metal structure according to an embodiment of the present disclosure.

FIG. 2 illustrates a case of emitting beams in a state in which a beamforming antenna is disposed at a groove of a metal structure, thus, the reason why a distortion of beams occurs may be determined according to an embodiment of the present disclosure.

Referring to FIG. 2, the beamforming antenna emits beams at a predetermined angle gap and scans a beam emission angle having a best channel environment. For example, in order to scan an optimal channel, the beamforming antenna may emit beams at a gap by 10° from −90° to +90°.

FIG. 2 illustrates, for example, a beamforming antenna 210 separately disposed by t at a surface of a metal structure 200 and illustrates a case in which a beam emission angle θ for scanning a channel of the beamforming antenna 210 is 60°.

Most beams (beam indicated by a solid line) emitted through the beamforming antenna 210 do not collide with the metal structure 200. However, some beams (beam indicated by a dotted line) may collide with the metal structure 200 to be scattered, and due to the scattered beams, a gain value of the beam may be reduced.

In consideration of such a phenomenon, in a structure of FIG. 2, two factors that reduce a gain value of a beam may be considered, one factor is a beam emission angle and the other factor is a separation distance t between the metal structure surface and the beamforming antenna.

As the beam emission angle is formed to be low, more beams may be scattered by a metal structure, and in this case, a gain value of the beam may reduce. Therefore, in order to prevent a gain value from reducing by a beam emission angle, a beam emission angle should be adjusted, but because the beam emission angle has a predetermined value according to a design of the beamforming antenna, it is not preferable to adjust the beam emission angle.

Therefore, in an embodiment of the present disclosure, a gain value loss of a beam is compensated in consideration of a separation distance t between the metal structure surface and the beamforming antenna, which is the other factor, and a gain value change according to a separation distance between the metal structure surface and the beamforming antenna will be described with reference to FIG. 3.

Figure 3:
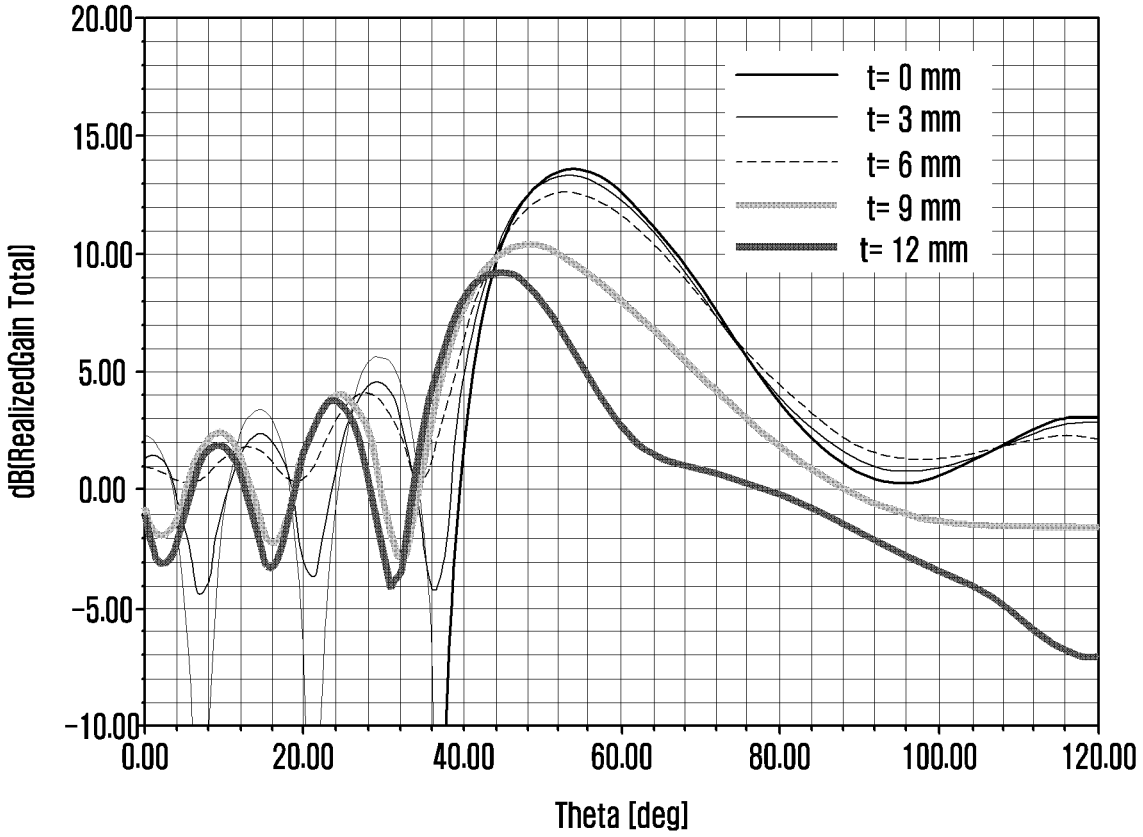
FIG. 3 is a graph illustrating a beamforming antenna performance according to a groove depth of a metal structure according to an embodiment of the present disclosure.

FIG. 3 is a graph illustrating a beamforming antenna performance according to a separation distance between a metal structure surface and a beamforming antenna according to an embodiment of the present disclosure.

Referring to FIG. 3, t means a depth of a groove provided to dispose a beamforming antenna at a metal structure, and as described above, more specifically, t of FIG. 3 is a separation distance between a metal structure surface and a beamforming antenna. Further, an x-axis of the graph is a beam emission angle, and a y-axis is a beam gain value.

In an example of FIG. 2, when a beam emission angle is 60°, if t increases, it may be determined that a gain value of the beamforming antenna reduces. More particularly, a gain value when t is 12 mm is smaller by about 10 dB than that when t is 0 mm.

For example, it may be determined that a beam gain value when t is 0 mm is larger by about 10 times than that when t is 12 mm. This is because as described with reference to FIG. 2, as t increases, beams scattered by a metal structure increase.

Therefore, the present an embodiment provides a method of compensating a gain value loss of the beamforming antenna even when a separation distance t exists between the metal structure surface and the beamforming antenna based on a graph of FIG. 3.

Only a gain value loss of the beamforming antenna occurring when a beam emission angle is 60° is described, but even when a separation distance exists between the metal structure surface and the beamforming antenna, a gain value loss of the beamforming antenna occurs regardless of a beam emission angle, thus, a method of compensating the gain value loss is required. For example, in an embodiment of the present disclosure, when a separation distance exists between the metal structure surface and the beamforming antenna regardless of a beam emission angle, a method of compensating the gain value loss may be applied.

Figure 4:
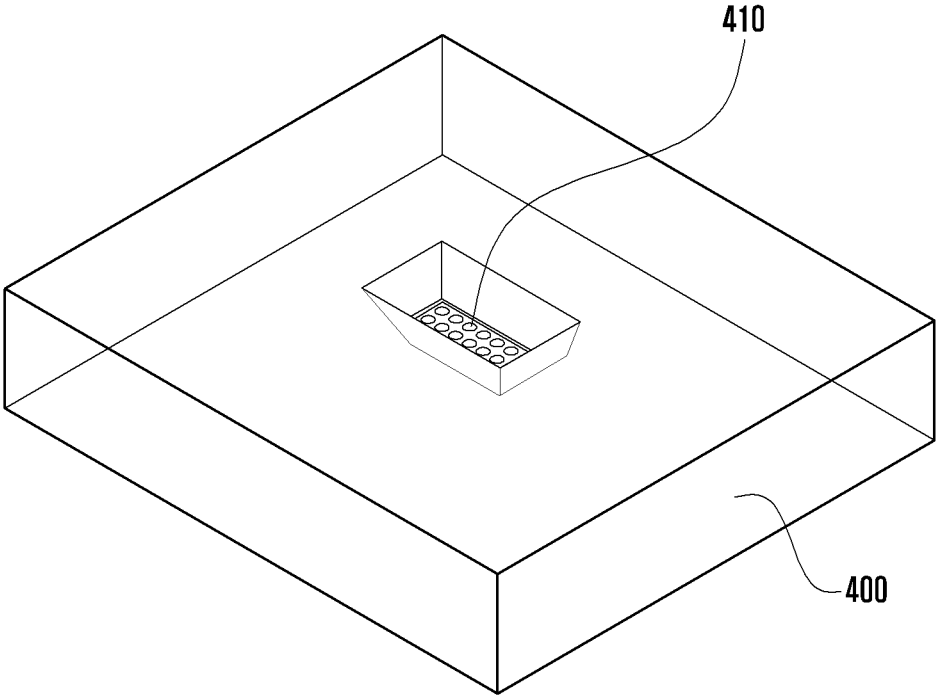
FIG. 4 is a diagram illustrating a groove structure of a metal structure according to an embodiment of the present disclosure.
Figure 4:
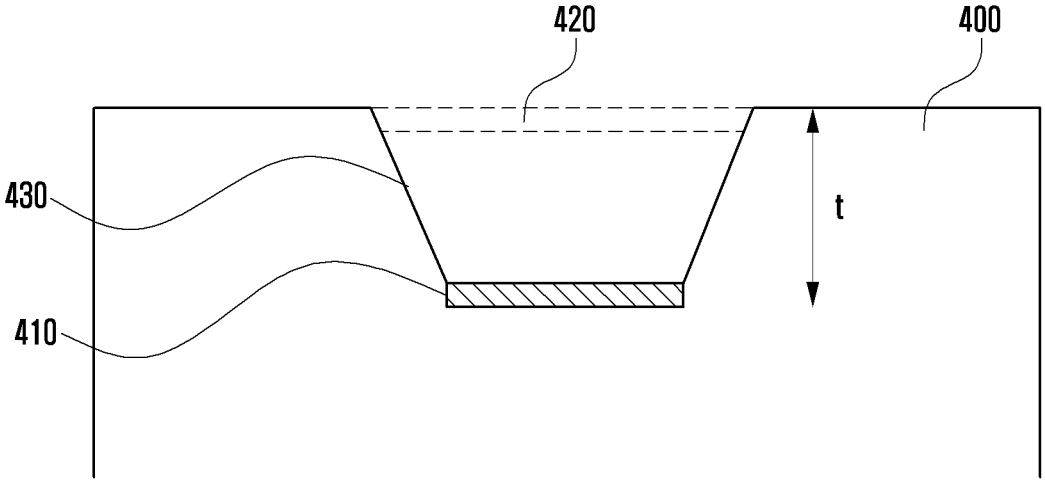

FIG. 4 illustrates a groove structure of a metal structure according to an embodiment of the present disclosure.

Referring to FIG. 4, a beamforming antenna 410 is disposed at a groove of a metal structure 400, and an outer edge of a groove of the metal structure 400 is extended to an outer edge of the beamforming antenna 410 to form an inclined surface 430. Here, the inclined surface 430 is formed such that an outermost area 420 of a groove of the metal structure 400 is larger than an area of the beamforming antenna 410.

The reason why forming the inclined surface 430 such that an outermost area 420 of a groove of the metal structure 400 is larger than an area of the beamforming antenna 410 is that beams emitted from the beamforming antenna 410 are guided along the inclined surface 430 to be emitted to the outside of the metal structure 400.

Therefore, according to an embodiment of the present disclosure, even if a separation distance t exists between a surface of the metal structure 400 and the beamforming antenna 410, beams emitted through the beamforming antenna 410 to be emitted to the outside of the metal structure 400 along the inclined surface 430, thus, a gain value loss of a beamforming antenna occurring by the separation distance described with reference to the graph of FIG. 3 may be compensated. A detailed description thereof will be described with reference to FIGS. 5A, 5B, 5C, and 6.

Figure 5A:
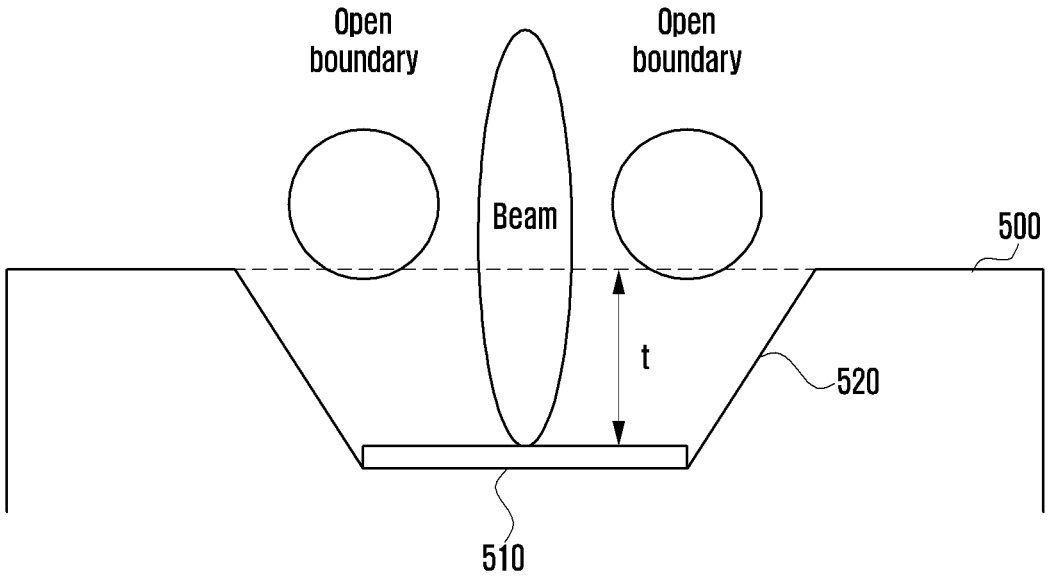
FIGS. 5A, 5B, and 5C are diagrams illustrating a boundary condition formed within a metal structure groove when a beamforming antenna emits beams according to an embodiment of the present disclosure.
Figure 5B:
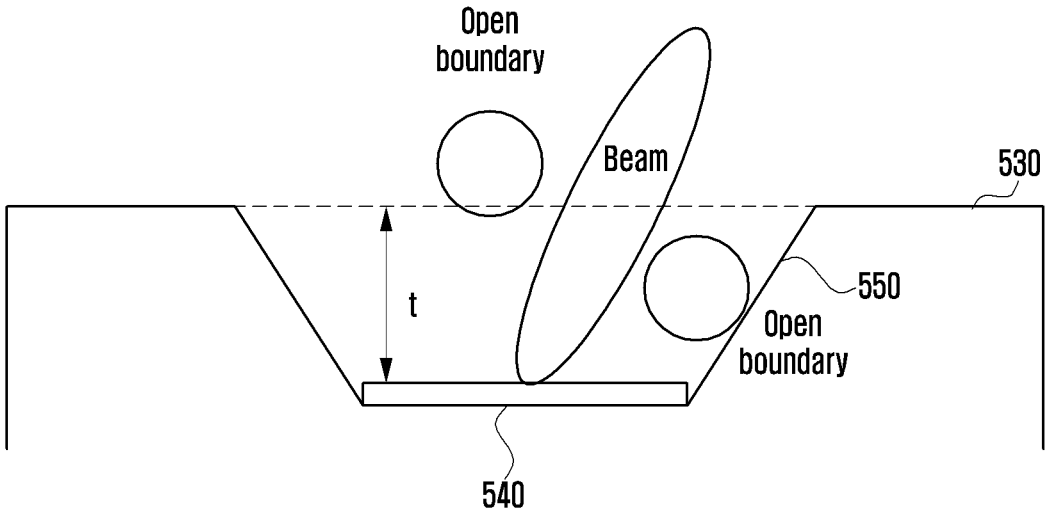
Figure 5C:
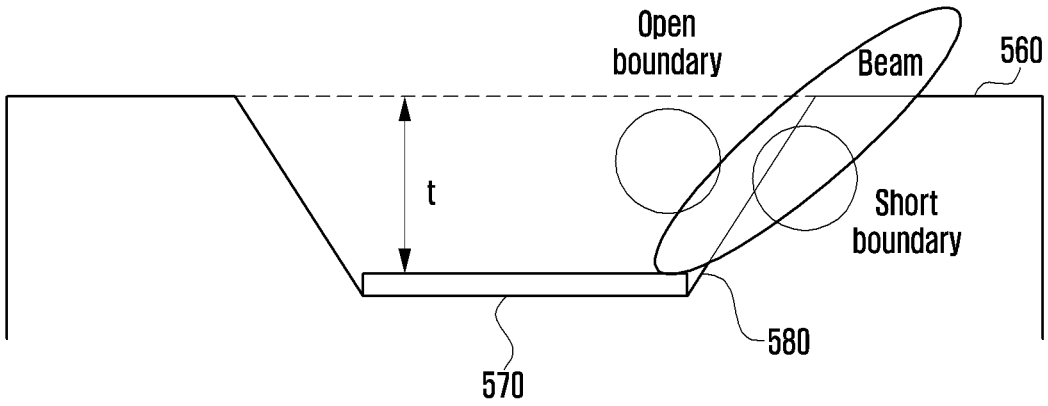

FIGS. 5A, 5B, and 5C are diagrams illustrating a boundary condition formed within a metal structure groove when a beamforming antenna emits beams according to an embodiment of the present disclosure.

Here, the boundary condition is a term using in electromagnetics and may include an electric boundary condition, magnetic boundary condition, open boundary condition, and short boundary condition.

Here, the open boundary condition is a condition in which an antenna or an electromagnetic wave emission device can efficiently transmit electric waves and means an interface condition in which emitted electric waves may be emitted to the outside without distortion. Specifically, in the open boundary condition, both a parallel direction component and a normal direction component of an electromagnetic field exist, and a distortion does not occur in beams emitted through a beamforming antenna, and a beam emission angle may be freely adjusted regardless of an external structure of a periphery of a beamforming antenna.

In contrast, the short boundary condition is a disadvantageous condition in electric wave transmission and means an interface condition in which electric waves are emitted to the outside in a state in which a gain value of electric waves is reduced. Specifically, in the short boundary condition, only a normal direction component of an electromagnetic field exists, and a parallel direction component thereof does not exist. Therefore, a beam emission angle is influenced by an external structure at a periphery of the beamforming antenna.

Referring to FIG. 5A, a case in which a beam emission angle is 90° is illustrated. When beams are emitted in an angle 90°, beams do not collide with an inclined surface 520 of a metal structure 500, and in this case, an open boundary condition is formed at both side surfaces of beams.

Therefore, when a beam emission angle is 90°, in beams emitted through a beamforming antenna 510, a gain value loss does not occur regardless of a separation distance t between a surface of the metal structure 500 and the beamforming antenna 510.

Referring to FIG. 5B, a case in which a beam emission angle is not 90°, but a case in which beams emitted through a beamforming antenna 540 do not collide with an inclined surface 550 of a metal structure 530 is illustrated.

In this case, as in a case of FIG. 5A, because beams do not collide with the inclined surface 550 of the metal structure 530, an open boundary condition is formed at both side surfaces of beams. Therefore, a gain value loss of beams emitted through the beamforming antenna 540 does not occur regardless of a separation distance t between a surface of the metal structure 530 and the beamforming antenna 540.

However, referring to FIG. 5C, a case in which a beam emission angle is not 90° and a case in which beams emitted through a beamforming antenna 570 collide with an inclined surface 580 of a metal structure 560 is illustrated.

In this case, a short boundary condition is formed between the inclined surface 580 colliding with beams and a portion of beams emitted through the beamforming antenna 570 is thus scattered, thus, a gain value of the beamforming antenna 570 may be reduced.

However, according to an embodiment of the present disclosure, even if a short boundary condition is formed at one side surface of beams, an open boundary condition is still formed at the other side surface of the beams, thus, beams are not scattered but are guided along the inclined surface 580 to be emitted to the outside of the metal structure 560.

Therefore, according to a structure of FIG. 5C, even if a separation distance t exists between a surface of the metal structure 560 and the beamforming antenna 570, a gain value loss may not occur.

Finally, according to an embodiment of the present disclosure, even if the beamforming antenna disposed within the metal structure emits beams to any angle, beams emitted through the beamforming antenna may not be scattered or reflected by a metal structure but may be emitted to the outside of the metal structure.

Figure 6:
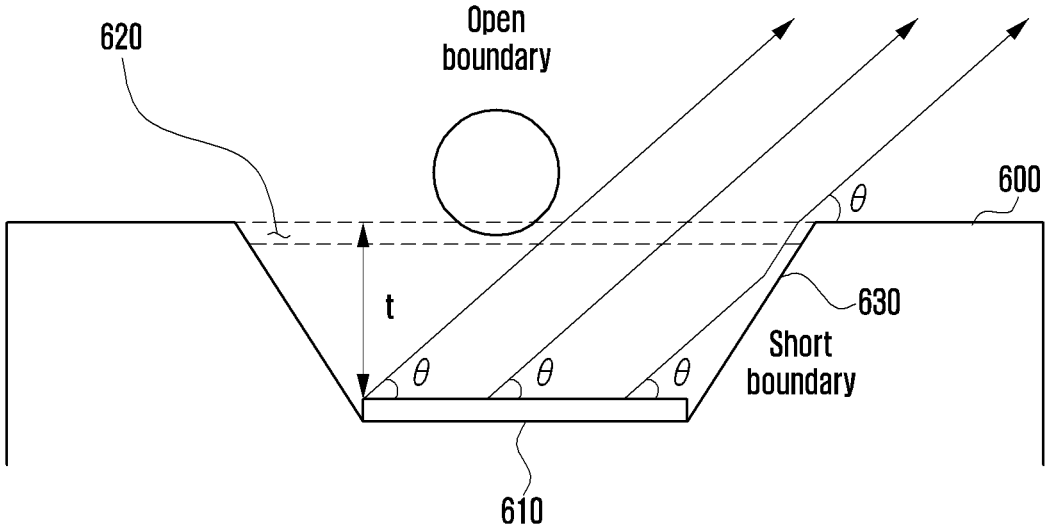
FIG. 6 is a diagram illustrating a beam emission shape when a beamforming antenna is disposed at a groove structure of a metal structure according to an embodiment of the present disclosure.

FIG. 6 is a diagram illustrating a beam emission shape when a beamforming antenna is disposed at a groove structure of a metal structure according to an embodiment of the present disclosure.

Referring to FIG. 6, a beam emission shape when a short boundary condition is formed at one side surface of a beam and when an open boundary condition is formed at the other side surface thereof is illustrated, as described with reference to FIG. 5B.

When a beamforming antenna 610 separately disposed by t from a metal structure surface 620 emits beams for scanning a channel in an angle of θ, a portion of the beams is emitted to the outside of the metal structure 600 without collision with the metal structure 600.

However, another portion of beams collides with an inclined surface 630 of the metal structure 600, thus, a short boundary condition is formed and a portion of beams emitted through the beamforming antenna 610 may be thus scattered.

However, according to an embodiment of the present disclosure, due to the inclined surface 630 extended from an outer edge of a metal structure groove to an outer edge of the beamforming antenna 610, an open boundary condition is formed at the opposite side of beams that collide with the inclined surface 630, thus, beams that collide with the inclined surface 630 are not scattered but are guided and moved along the inclined surface 630.

Further, when the beams are guided and moved along the inclined surface 630 to be deviated to the outside of the metal structure 600, an open boundary condition is formed at both side surfaces of beams, and the beams are emitted to the outside of the metal structure 600 while maintaining again an angle θ.

Therefore, beams emitted in an angle θ through the beamforming antenna 610 within the metal structure are emitted to the outside of the metal structure 600 while maintaining the angle θ, and according to an embodiment of the present disclosure, performance deterioration of a beamforming antenna by a metal, i.e., a gain value loss can be prevented from occurring.

Figure 7:
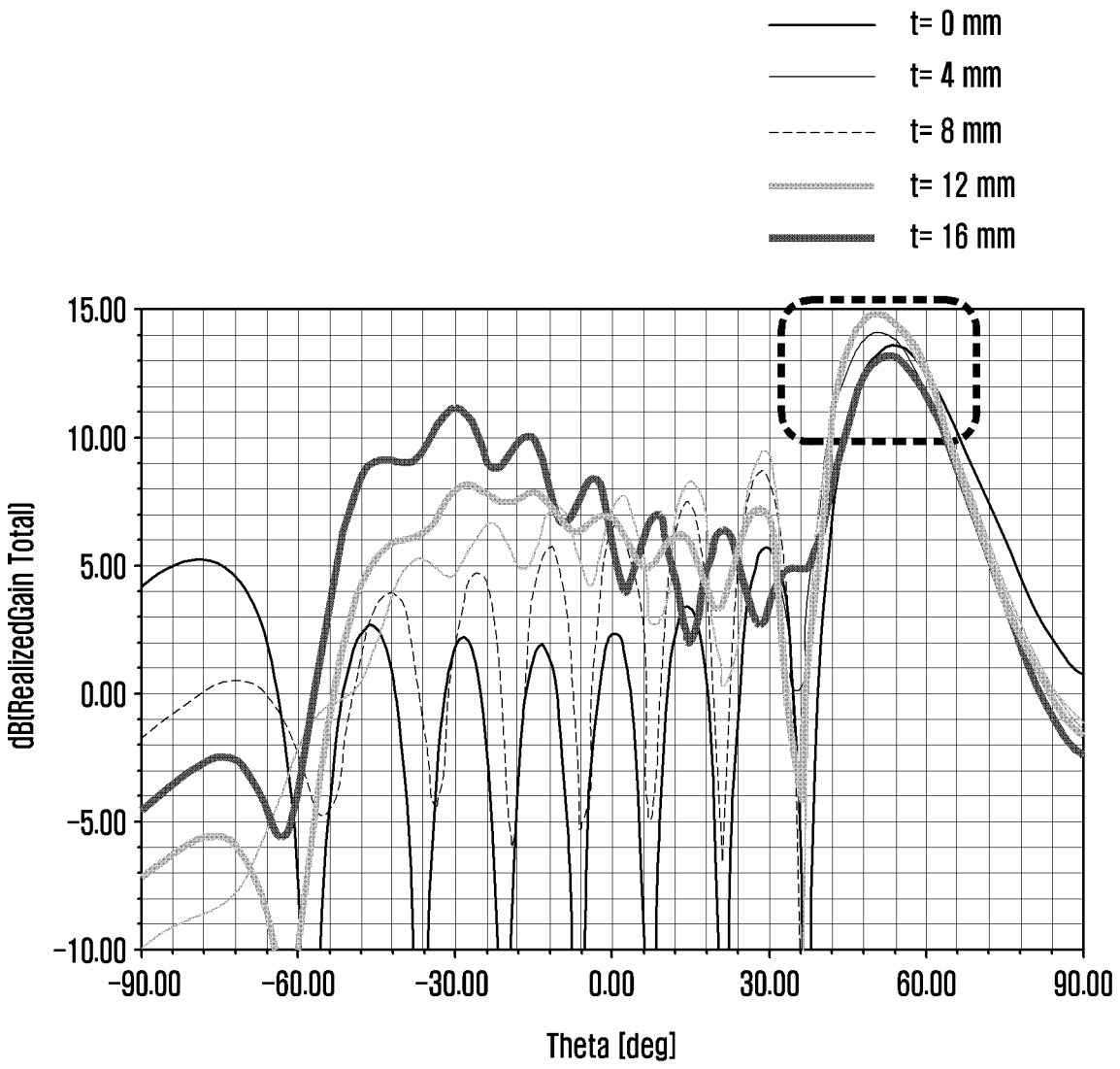
FIG. 7 is a graph illustrating an enhanced beamforming antenna performance according to an embodiment of the present disclosure.

FIG. 7 is a graph illustrating an enhanced beamforming antenna performance according to an embodiment of the present disclosure.

Referring to FIG. 7, in a case in which a beam emission angle θ is 60°, when a distance t between a metal structure surface and the beamforming antenna is 12 mm, if a gain value and t are 0 mm, it may be determined that the gain value is almost the same.

Further, a gain value when t is 16 mm is almost the same as that when t is 0 mm. For example, according to a metal structure including an inclined surface described in an embodiment of the present disclosure, even if a separation distance t exists between the metal structure surface and the beamforming antenna, it may be determined that a gain value loss does not occur.

Thereby, according to a structure described in an embodiment of the present disclosure, by disposing a beamforming antenna within the metal structure, the beamforming antenna can be protected from an external impact and a gain value loss that may occur by disposing the beamforming antenna within the metal structure can be prevented.

Figure 8A:
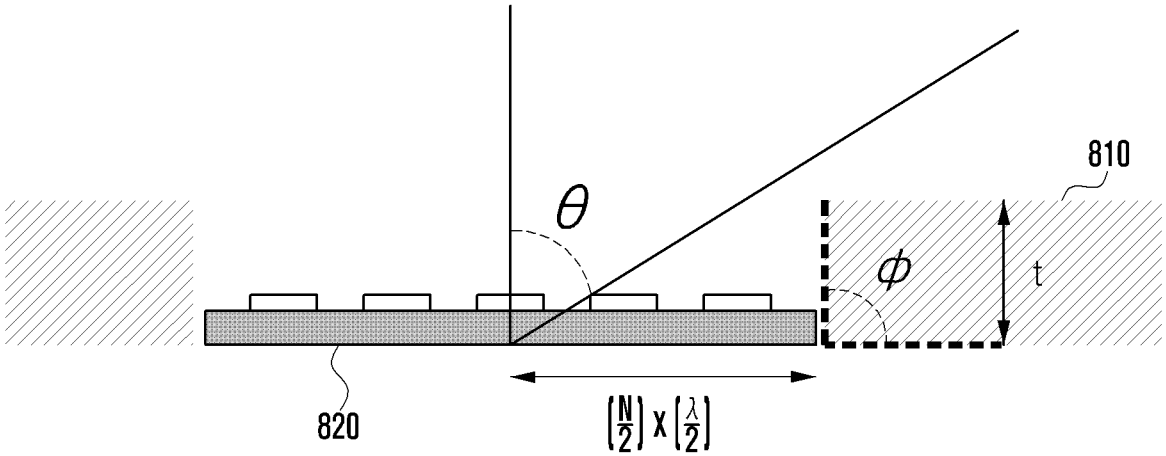
FIGS. 8A and 8B are diagrams illustrating a method of determining a tilt angle of an inclined surface according to an embodiment of the present disclosure.
Figure 8B:
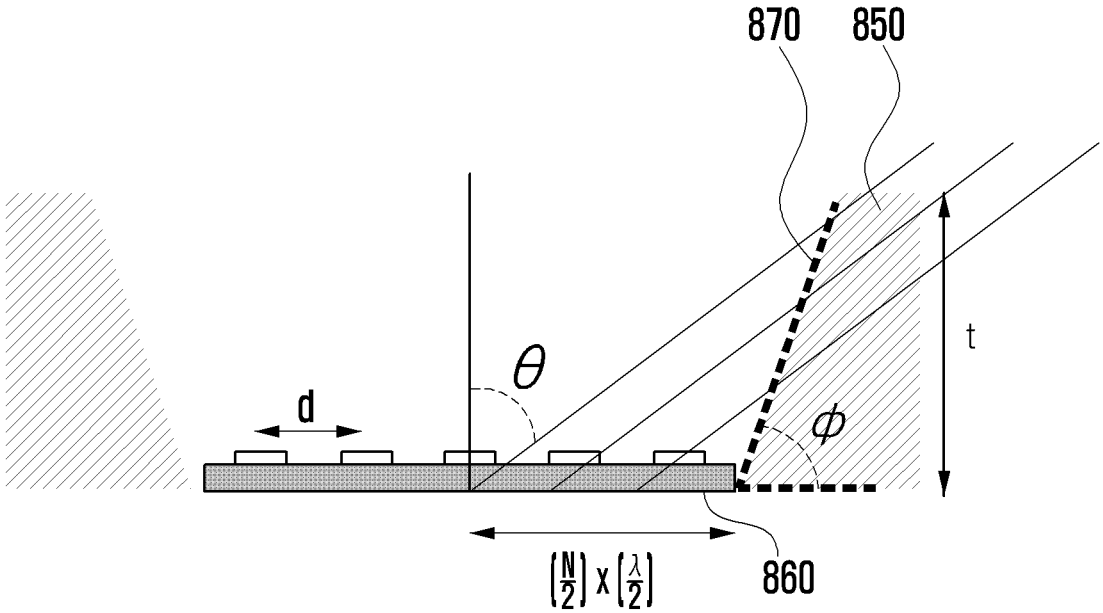

FIGS. 8A and 8B are diagrams illustrating a method of determining a tilt angle of a metal structure according to an embodiment of the present disclosure.

Referring to FIG. 8A, a case is illustrated in which beams emitted through a beamforming antenna 820 are not scattered or reflected by a metal structure, even if an inclined surface is not formed in a metal structure 810, because a separation distance t between a surface of the metal structure 810 and the beamforming antenna 820 is small.

For example, FIG. 8A illustrates a case in which a separation distance t between a surface of the metal structure 810 and the beamforming antenna 820 satisfies Equation 1.

$$t < \frac{N\lambda}{4}\tan\left(\frac{\pi}{2} - \theta\right) \quad \text{Equation 1}$$

where t: a separation distance between a metal structure surface and a beamforming antenna, λ: a wavelength of the beamforming antenna, θ: a maximum emission angle of the beamforming antenna, N: an integer value (0, 1, 2, . . . )

In this case, even if beams emitted by the beamforming antenna 820 are emitted in a maximum emission angle, as shown in FIG. 5A, the beams do not collide with the metal structure 810, thus, a tilt angle of the metal structure should be 90° or less. (When a tilt angle of the metal structure exceeds 90°, the metal structure may collide with beams, thus, it is preferable that a tilt angle of the metal structure is 90° or less.)

However, referring to FIG. 8B, a case is illustrated in which a separation distance t between a surface of a metal structure 850 and a beamforming antenna 860 is larger than a separation distance of FIG. 8A and illustrates a case of satisfying Equation 2.

$$t > \frac{N\lambda}{4}\tan\left(\frac{\pi}{2} - \theta\right) \quad \text{Equation 2}$$

where t: a separation distance between a metal structure surface and a beamforming antenna, λ: a wavelength of the beamforming antenna, θ: a maximum emission angle of the beamforming antenna, N: an integer value (0, 1, 2, . . . )

In this case, when a beam emission angle exceeds a specific value, beams emitted by the beamforming antenna 860 may collide with the metal structure 850. Therefore, as described in an embodiment with reference to FIG. 6, it is necessary to form an inclined surface 870 in the metal structure 850.

As a tilt angle is theoretically formed to be low, a probability is reduced in which beams emitted through a beamforming antenna are to be blocked, thus, in order to prevent a gain value loss, it is preferable to form a tilt angle to be low.

However, as a tilt angle is lowered, a size of a groove formed in a metal structure increases, thus, stability of the metal structure is deteriorated and it is difficult to protect the beamforming antenna from an external impact.

Therefore, it is important to determine an optimal tilt angle that may minimize a groove size of the metal structure while minimizing a gain value loss, and according to a case of FIG. 8B, a tilt angle may be determined based on a wavelength of the beamforming antenna and may be determined by Equation 3.

$$\text{Max}\,\phi \le 1.25\,\sin^{-1}\left(\frac{\lambda}{2\pi d}\psi\right) \quad \text{Equation 3}$$

where φ: a tilt angle, λ: a wavelength of a beamforming antenna, d: a distance between the centers of beamforming antenna elements, Ψ: a phase difference between beamforming antennas Here, the beamforming antenna element means one beamforming antenna, i.e., a plurality of beamforming antenna elements constituting one beamforming antenna array, and FIG. 8B illustrates a case in which a distance between the centers of beamforming antenna elements is d.

Figure 9:
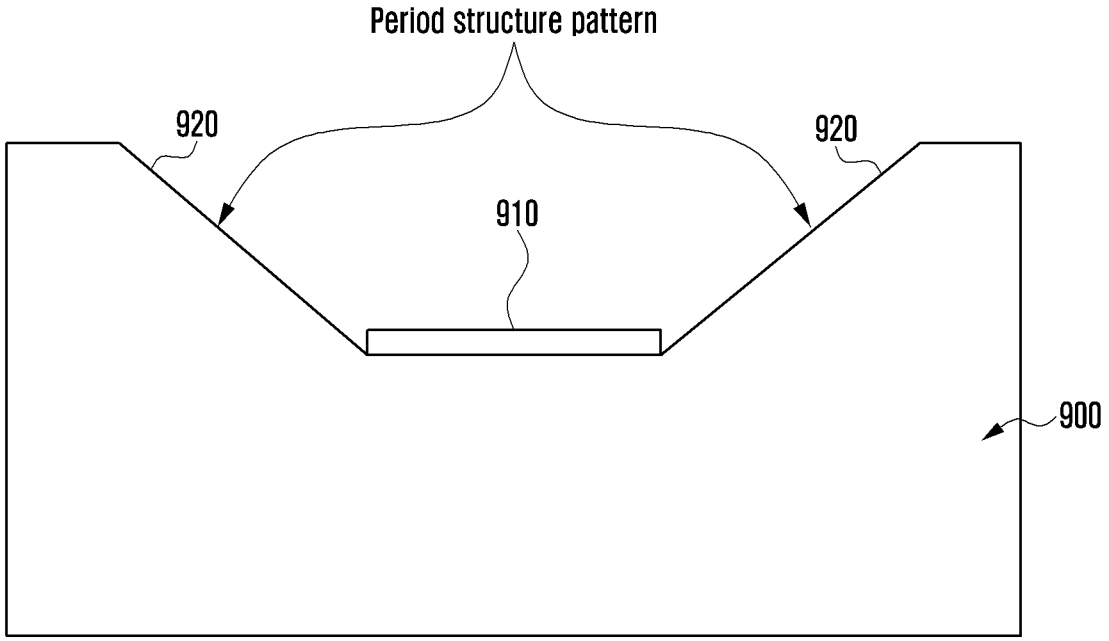
FIG. 9 is a diagram illustrating a case in which a period structure pattern is formed at an inclined surface of a metal structure according to an embodiment of the present disclosure.

FIG. 9 is a diagram illustrating a case in which a period structure pattern is formed at an inclined surface of a metal structure according to an embodiment of the present disclosure.

Referring to FIG. 9, beams emitted through a beamforming antenna 910 may be guided and moved along an inclined surface 920 of a metal structure 900, and the moved beams may minimize a gain value loss by the pattern to be emitted to the outside of the metal structure 900.

The period structure pattern may have a shape that periodically arranges a pattern having a length smaller than a wavelength of beams emitted through a beamforming antenna and randomly adjust a property of EM waves through the period structure pattern.

For example, the inclined surface 920 may perform a function of an artificial magnetic conductor (AMC), frequency selective surface (FSS), or lens through the period structure pattern.

In general, in a conductor, a parallel component of an electric field becomes 0 and a parallel component of a magnetic field has a maximum value, and a normal component of an electric field has a maximum value and a normal component of a magnetic field is 0.

However, in an AMC made in a period structure, a parallel component of a magnetic field becomes 0 and a parallel component of an electric field has a maximum value, and a normal component of a magnetic field has a maximum value, and a normal component of an electric field becomes 0, thus, by forming an AMC at the inclined surface 920 of the metal structure 900 in a period structure pattern, a property of electromagnetic (EM) waves emitted through the metal structure may be randomly adjusted.

The FSS may be designed in a period structure pattern similar to the AMC, and by passing through only necessary electric waves among electric waves emitted from the antenna through the FSS and by reflecting electric waves of other frequencies, noise can be reduced.

The lens means a device that can randomly adjust an emission angle of beams and beam energy by changing a phase of beams emitted through the antenna, and electric waves emitted from the antenna may be effectively emitted to the outside of the metal structure through the lens.

Figure 10:
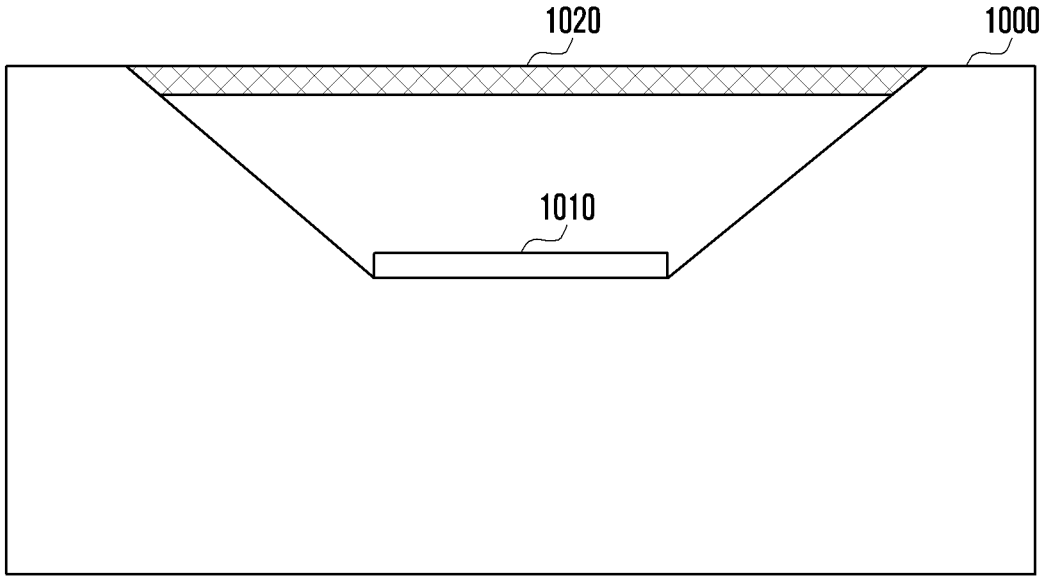
FIG. 10 is a diagram illustrating a case in which a radome is formed at a groove of a metal structure according to an embodiment of the present disclosure.

FIG. 10 is a diagram illustrating a case in which a radome is formed at a groove of a metal structure according to an embodiment of the present disclosure.

Referring to FIG. 10, when a beamforming antenna 1010 is disposed at a groove of a metal structure 1000, the beamforming antenna 1010 may be less damaged by an external impact than when the beamforming antenna 1010 is disposed at the outside of the metal structure 1000.

However, even if the beamforming antenna 1010 is disposed within the metal structure 1000, the beamforming antenna 1010 may be damaged by an external impact, and in order to address such an issue, FIG. 10 illustrates an embodiment that disposes a radome 1020 at a groove of the metal structure 1000.

The radome means a cover for protecting an antenna, and for good transmission of electric waves, a material thereof is configured with an electric insulating material, and it is preferable that the radome is formed in an integral form having no joint.

Further, because the radome is provided to protect an antenna from an external impact, as described with reference to FIG. 9, it is preferable to correspond an external form of a radome 1020 with a surface of the metal structure 900.

Further, similar to the period structure pattern of FIG. 9, for enhancement of a performance, a method of including the FSS or the phase converter in the radome may be considered.

Further, by adding the embodiment of FIG. 9 to an embodiment of FIG. 10, an embodiment that forms a pattern of a period structure at an inclined surface of a metal structure while forming the radome at a metal structure groove may be considered.

As described above, in addition to a case of forming an inclined surface by extending a metal structure to an outer edge of a beamforming antenna, a method of disposing an inclined surface between a metal structure groove and an outer edge of the beamforming antenna as a separate embodiment may be considered.

For example, an embodiment of the present disclosure may include a beamforming antenna assembly including a metal structure having a groove, a beamforming antenna disposed at the metal structure groove, and a guide surface disposed between the beamforming antenna and the metal structure along an outer edge of the beamforming antenna and an outer edge of the metal structure groove to guide beams emitted from the beamforming antenna.

In this case, as in the foregoing embodiment of the present disclosure, an outermost area of the metal structure groove may be larger than an area of the beamforming antenna, and the guide surface may be disposed to form a tilt angle by a predetermined angle along an outer edge of the beamforming antenna and an outer edge of the metal structure groove to enlarge an emission area of beams emitted through the beamforming antenna.

However, the guide surface is disposed between the beamforming antenna and the metal structure along an outer edge of the beamforming antenna and an outer edge of the metal structure groove, and it is unnecessary that the guide surface is connected to the beamforming antenna and the metal structure.

For example, as shown in FIG. 4, when an outer edge of the beamforming antenna is a rectangle shape and when an outer edge of the metal structure groove is a rectangle shape, it is unnecessary that a guide surface is connected to both of four sides of the beamforming antenna and four sides of the metal structure hole.

Further, as described above, in this case, in a tilt angle of the guide surface, when one side surface of beams emitted through the beamforming antenna contacts the guide surface to satisfy a short boundary condition, the other side surface of the beam may be formed to satisfy an open boundary condition. Similarly, a tilt angle of the guide surface may be determined based on a wavelength of the beamforming antenna.

At the guide surface, a period structure pattern may be formed, and the period structure pattern may include an AMC, FSS, or Lens pattern.

Further, an embodiment including a guide surface may further include a radome configured to cover a groove, and the radome may include an FSS or a phase converter.

Further, because the present disclosure has a structure that receives a beamforming antenna at a metal, the present disclosure may be applied even to a metal frame or a metal panel for a vehicle.

Figure 11:
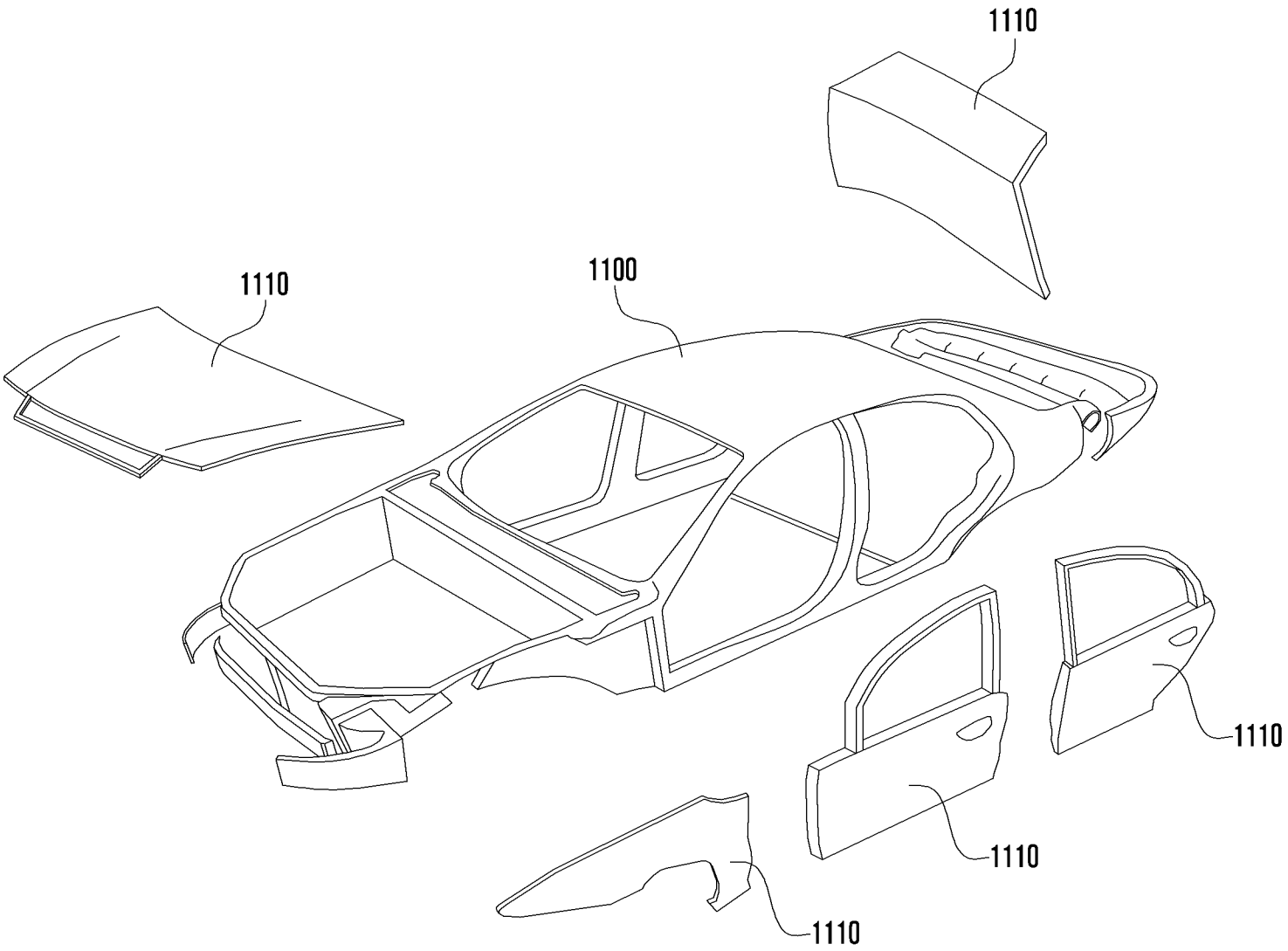
FIG. 11 is an exploded perspective view illustrating a vehicle structure in which a beamforming antenna is disposed according to an embodiment of the present disclosure.

FIG. 11 is an exploded perspective view illustrating a vehicle structure in which a beamforming antenna is disposed according to an embodiment of the present disclosure.

Referring to FIG. 11, a vehicle may be configured with a metal frame 1100 and a metal panel 1110. The metal frame 1100 is a frame of the vehicle and has high rigidity. However, the metal panel 1110 is used for a fender or a bonnet of the vehicle and has a thin thickness.

A beamforming antenna according to an embodiment of the present disclosure may be applied to both the metal frame 1100 and the metal panel 1110. From a production or vehicle stability viewpoint, it is preferable to form a groove at the metal panel 1110 rather than the metal frame 1100 and to dispose the beamforming antenna. However, in order to protect from an external impact, it is preferable to dispose the beamforming antenna within the metal frame 1100 having high rigidity.

Figure 12:
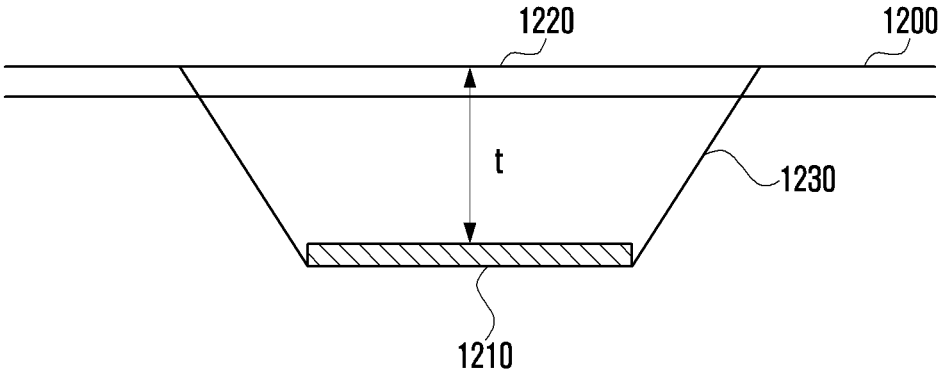
FIG. 12 is a diagram illustrating a case in which a beamforming antenna is disposed at a metal panel for a vehicle according to an embodiment of the present disclosure.

FIG. 12 is a diagram illustrating a case in which a beamforming antenna is disposed at a metal panel for a vehicle according to an embodiment of the present disclosure.

Referring to FIG. 12, similar to a beamforming antenna assembly using the foregoing metal structure, a beamforming antenna assembly for a vehicle according to an embodiment of the present disclosure may include a metal panel 1200 for a vehicle having a groove and a beamforming antenna 1210 disposed at a groove of the metal panel 1200, and an outer edge of a groove of the metal panel 1200 may be extended to an outer edge of the beamforming antenna 1210 to form an inclined surface 1230.

Further, a radome 1220 configured to cover the groove may be further included and requires rigidity similar to that of the metal panel 1200 in addition to the foregoing characteristic. For example, a method of forming the radome with fiber reinforced plastics (FRP) may be considered.

In a beamforming antenna assembly in which a beamforming antenna is disposed at a groove of the metal panel, an outermost area of the metal panel groove may be larger than an area of the beamforming antenna, thus, beams emitted from the beamforming antenna may be guided along a metal panel inclined surface to be emitted to the outside of the metal panel.

As described above, a beamforming antenna may be disposed at a metal frame of a vehicle in addition to a metal panel, and in this case, a beamforming antenna assembly for a vehicle according to an embodiment of the present disclosure includes a metal frame for a vehicle having a groove, and a beamforming antenna disposed at the metal frame groove, and an outer edge of the metal frame groove may be extended to an outer edge of the beamforming antenna to form an inclined surface.

An outermost area of the metal frame groove may be larger than an area of the beamforming antenna, thus, beams emitted from the beamforming antenna may be guided along the metal frame inclined surface to be emitted to the outside of the metal frame.

According to an embodiment of the present disclosure, because beams emitted through a beamforming antenna can be transmitted to the outside of a metal without distortion by the metal, a performance of the beamforming antenna can be prevented from being deteriorated.

Further, according to an embodiment of the present disclosure, by disposing a beamforming antenna within a metal, the beamforming antenna can be protected from an impact that may occur at the outside, thus, a beamforming antenna assembly according to the present disclosure can be used even in a vehicle using a metal frame.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A beamforming antenna assembly comprising:

a metal structure including a groove with a bottom and at least one side having an inclined surface of a predetermined angle; and a beamforming antenna disposed at the bottom of the groove, wherein the groove is formed on a surface of the metal structure, and wherein the inclined surface of the metal structure has a pattern based on a wavelength of a beam emitted through the beamforming antenna.

2. The beamforming antenna assembly of claim 1, wherein the inclined surface is configured to guide beams emitted from the beamforming antenna along the at least one side having the inclined surface.

3. The beamforming antenna assembly of claim 1, wherein an outermost area of the groove is larger than an area of the beamforming antenna.

4. The beamforming antenna assembly of claim 1, wherein the inclined surface is configured such that, when at least one beam emitted through the beamforming antenna contacts the inclined surface to satisfy a short boundary condition, the at least one beam forms a tilt angle to satisfy an open boundary condition.

5. The beamforming antenna assembly of claim 1, wherein the inclined surface is configured to guide beams emitted in a predetermined emission angle from the beamforming antenna along the at least one side having the inclined surface while maintaining the emission angle to an outside of the metal structure.

6. The beamforming antenna assembly of claim 1, wherein a tilt angle of the inclined surface of the metal structure is configured based on a wavelength of the beamforming antenna.

7. The beamforming antenna assembly of claim 1, wherein the pattern of the inclined surface of the metal structure comprises a period structure pattern.

8. The beamforming antenna assembly of claim 1, further comprising a radome configured to cover the groove, wherein the radome comprises at least one of a frequency selective surface (FSS) or a phase converter.

9. A beamforming antenna assembly comprising:

a metal structure including a groove with a bottom and at least one side having an inclined surface;

a beamforming antenna disposed at the bottom of the groove; and a guide surface disposed between the beamforming antenna and the metal structure along the at least one side and configured to guide beams emitted from the beamforming antenna, wherein the inclined surface of the metal structure has a pattern based on a wavelength of a beam emitted through the beamforming antenna.

10. The beamforming antenna assembly of claim 9, wherein an outermost area of the groove is larger than an area of the beamforming antenna.

11. The beamforming antenna assembly of claim 9, wherein the guide surface is disposed to form a tilt angle by a predetermined angle along the at least one side to enlarge an emission area of beams emitted through the beamforming antenna.

12. The beamforming antenna assembly of claim 11, wherein the guide surface is configured such that, when one side surface of at least one beam emitted through the beamforming antenna contacts the guide surface to satisfy a short boundary condition, the at least one beam is formed to satisfy an open boundary condition, and wherein the tilt angle of the guide surface is configured based on a wavelength of the beamforming antenna.

13. The beamforming antenna assembly of claim 9, wherein the pattern of the inclined surface comprises a period structure pattern.

14. The beamforming antenna assembly of claim 9, further comprising a radome configured to cover the groove, wherein the radome comprises at least one of a frequency selective surface (FSS) or a phase converter.

15. A beamforming antenna assembly for a vehicle comprising:

a metal frame for a vehicle including a groove with a bottom and at least one side having an inclined surface of a predetermined angle; and a beamforming antenna disposed at the bottom of the groove, wherein the groove is formed on a surface of the metal frame, and wherein the inclined surface of the metal frame has a pattern based on a wavelength of a beam emitted through the beamforming antenna.

16. The beamforming antenna assembly of claim 15, wherein the inclined surface is configured to guide beams emitted from the beamforming antenna along the at least one side having the inclined surface.

17. The beamforming antenna assembly of claim 15, wherein an outermost area of the groove is larger than an area of the beamforming antenna, and wherein the inclined surface is configured to guide beams emitted within a predetermined emission angle from the beamforming antenna along the at least one side having the inclined surface while maintaining the emission angle to an outside of the metal frame.

18. A beamforming antenna assembly for a vehicle comprising a metal panel for a vehicle including a groove with a bottom and at least one side having an inclined surface of a predetermined angle; and a beamforming antenna disposed at the bottom of the groove, wherein the groove is formed on a surface of the metal panel, and wherein the inclined surface of the metal panel has a pattern based on a wavelength of a beam emitted through the beamforming antenna.

19. The beamforming antenna assembly of claim 18, further comprising a radome configured to cover the groove, wherein the radome comprises at least one of a frequency selective surface (FSS) or a phase converter.

20. The beamforming antenna assembly of claim 18, wherein the inclined surface is configured to guide beams emitted within a predetermined emission angle from the beamforming antenna along the at least one side having the inclined surface while maintaining the emission angle to an outside of the metal panel.

* * * * *